US007573360B2

(12) United States Patent
Bryan et al.

(10) Patent No.: US 7,573,360 B2
(45) Date of Patent: Aug. 11, 2009

(54) CIRCUIT AND METHOD FOR WETTING RELAY CONTACTS

(75) Inventors: Lyle Stanley Bryan, Winston-Salem, NC (US); Robert Daniel Irlbeck, Greensboro, NC (US)

(73) Assignee: Tyco Electronics Corporation, Middletown, PA (US)

( * ) Notice: Subject to any disclaimer, the term of this patent is extended or adjusted under 35 U.S.C. 154(b) by 258 days.

(21) Appl. No.: 11/502,092

(22) Filed: Aug. 10, 2006

(65) Prior Publication Data

US 2007/0040638 A1 Feb. 22, 2007

Related U.S. Application Data

(60) Provisional application No. 60/708,948, filed on Aug. 17, 2005.

(51) Int. Cl.
*H01H 9/30* (2006.01)

(52) U.S. Cl. ..... 335/201; 335/78

(58) Field of Classification Search ..... 335/201–202; 200/400, 401

See application file for complete search history.

(56) References Cited

U.S. PATENT DOCUMENTS 5,534,178 A * 7/1996 Bailly et al. ..... 510/367
5,675,238 A * 10/1997 Asao ..... 322/28
5,714,731 A * 2/1998 Ulrich et al. ..... 219/130.4

* cited by examiner

*Primary Examiner*—Elvin G Enad
*Assistant Examiner*—Bernard Rojas

(57) ABSTRACT

A circuit for wetting relay contacts includes a relay having a relay coil, a movable contact and a stationary contact. The movable contact is movable between an open position and a closed position upon energizing of the relay coil, and the movable contact engages the stationary contact in the closed position. The movable contact is moved from the closed position to the open position when the relay coil is de-energized. A transistor is connected to the relay coil through a load, wherein the transistor loads the relay coil after the relay coil is de-energized to provide an arc between the movable contact and the stationary contact as the movable contact is moved from the closed position to the open position.

18 Claims, 2 Drawing Sheets

CIRCUIT AND METHOD FOR WETTING RELAY CONTACTS

CROSS REFERENCE TO RELATED APPLICATIONS

This application claims priority to U.S. Provisional Application Ser. No. 60/708,948, filed Aug. 17, 2005, which is hereby incorporated by reference in its entirety.

BACKGROUND OF THE INVENTION

The invention relates generally to electrical relays, and more particularly, the invention relates to a circuit and a method for wetting relay contacts.

Electromechanical relays are used in many applications. In some applications the relays are used for switching of currents and/or loads. However, in some applications, the relays are used only for isolation of the voltage or for an additional level of control for security. These isolation-type relays include circuits, sometimes referred to as dry circuits, having loads that are not opened or closed by the contacts. Instead, current may flow through the contacts after closure and before opening, but the contact does not directly control the load. The relay contacts simply control power to another device that in turn controls the load.

In circuits where the relay is not used for switching of the current, over time, damaging chemicals, such as, oxides and hydrocarbons are formed on the relay contacts. The build-up increases the contact resistance which can cause a voltage drop and/or heating of the contacts. Additionally, with continued build-up of chemicals, the relay may maintain an open circuit even when a relay is energized and should close.

Currently, many circuits are designed without any compensation for chemical build-up. On the other hand, some existing circuits, which are designed to prevent or diminish the chemical build-up on the contacts, use additional costly components, such as relays, capacitors and resistors to pre-charge the contact when closing the relay. This is commonly called "wetting" the contact. What is needed is an inexpensive, yet efficient circuit or method of wetting contacts.

BRIEF DESCRIPTION OF THE INVENTION

In one aspect, a circuit is provided for wetting relay contacts. The circuit includes a relay having a relay coil, a movable contact and a stationary contact. The movable contact is movable between an open position and a closed position upon energizing of the relay coil, and the movable contact engages the stationary contact in the closed position. The movable contact is moved from the closed position to the open position when the relay coil is de-energized. A transistor is connected to the relay coil through a load, wherein the transistor loads the relay coil after the relay coil is de-energized to provide an arc between the movable contact and the stationary contact as the movable contact is moved from the closed position to the open position.

In another aspect, a circuit is provided for wetting relay contacts, wherein the circuit includes a relay having a relay coil, a movable contact and a stationary contact. The relay coil is configured to move the movable contact between an open position and a closed position upon energizing and de-energizing of the relay coil. The circuit also includes a transistor connected to the relay coil, wherein the transistor is positioned between the movable contact and a ground through a load. The transistor loads the relay coil after the relay coil is de-energized to provide an arc between the movable contact and the stationary contact as the movable contact is moved from the closed position to the open position.

In a further aspect, a method of wetting relay contacts is provided that includes providing an electromechanical relay having a coil, a movable contact and a stationary contact, energizing the coil to move the movable contact to a closed position in contact with the stationary contact, de-energizing the coil to allow the movable contact to move to an open position, and maintaining a load on at least one of the movable contact and the stationary contact after the relay is de-energized using a wetting circuit having a transistor.

DETAILED DESCRIPTION OF THE INVENTION

Figure 1:
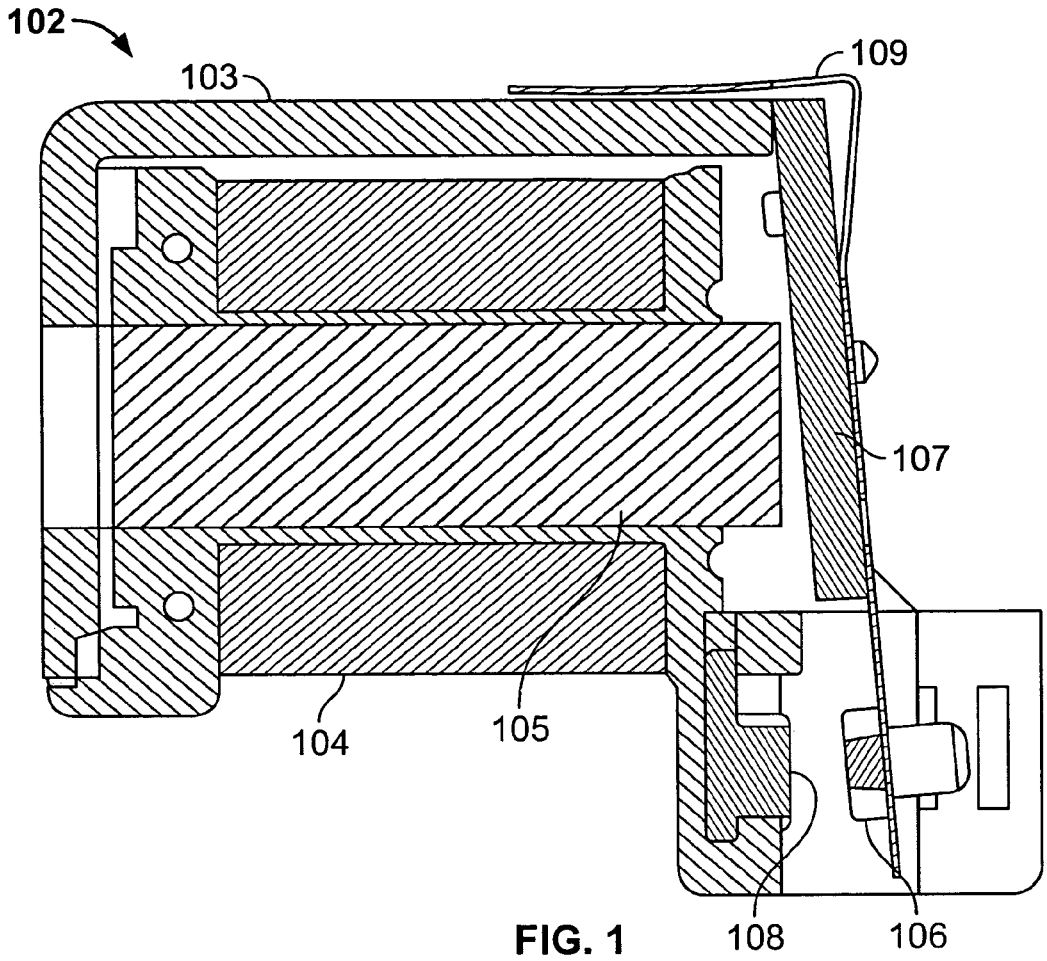
FIG. 1 is a cross-sectional view of an electromagnetic relay formed in accordance with an exemplary embodiment.

FIG. 1 is a cross-sectional view of an electromagnetic relay 102 formed in accordance with an exemplary embodiment. Other types of relays may also be used. Relay 102 includes a yoke 103, a coil 104 that surrounds a core 105, and a movable armature 107. Relay 102 includes a stationary contact 108 and a movable contact 106 that is attached to a spring 109. The spring 109 biases the armature 107 away from the core 105 so that the contacts 106, 108 are normally open. When sufficient current is present in the coil 104, the relay 102 is energized and the armature 107 is magnetically attracted to the core 105 moving the armature 107 toward the core 105 and moving the movable contact 106 into engagement with the stationary contact 108.

Figure 2:
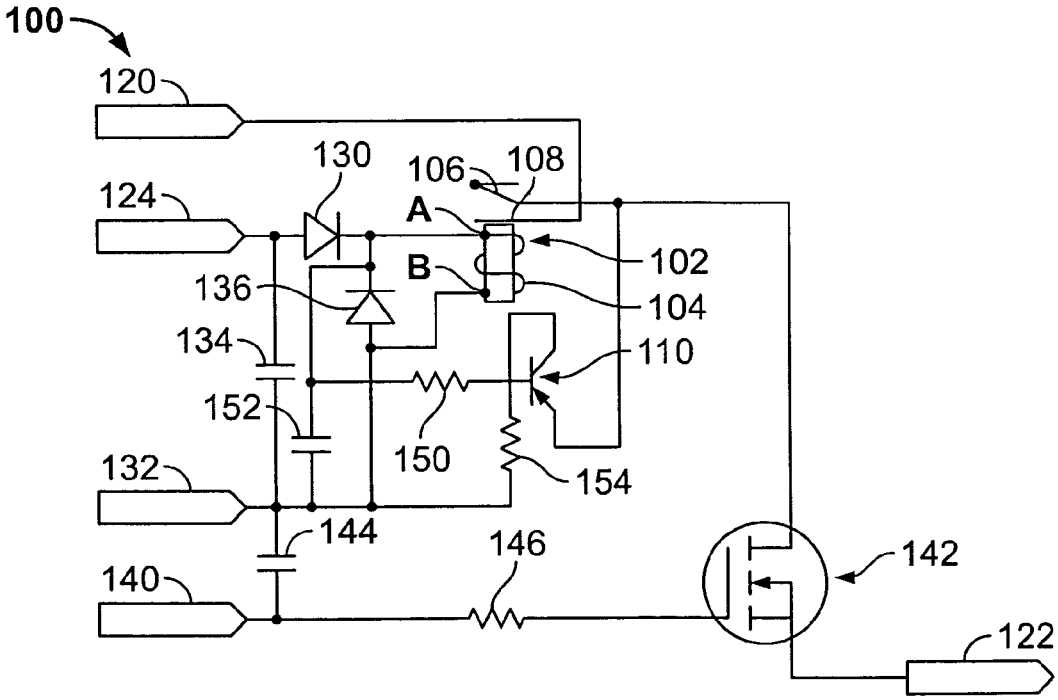
FIG. 2 shows a schematic of a relay wetting circuit formed in accordance with an exemplary embodiment and that may be used with the relay shown in FIG. 1.

FIG. 2 shows a schematic of a relay wetting circuit 100 formed in accordance with an exemplary embodiment of the present invention. The relay wetting circuit may form a portion of another circuit, such as a relay circuit or another electrical circuit. The relay wetting circuit 100 includes the relay 102 having the relay coil 104, the movable contact 106 and the stationary contact 108. The relay wetting circuit 100 is used for wetting the contacts 106, 108 upon de-energization of the relay 102. For example, when the relay 102 is de-energized, the movable contact 106 is in an open position and is not engaging the stationary contact 108. However, upon energization of the relay 102, the movable contact 106 is moved to a closed position and engages the stationary contact 108. Upon de-energization of the relay 102, the movable contact is again moved to the open position. The relay wetting circuit 100 is used to provide arcing or an electrical charge between the contacts 106, 108 as the movable contact 106 is moved back to the open position. The arc created between the contacts 106, 108 cleans or removes chemical build-up from the contacts 106, 108 that may accumulate over time. In an exemplary embodiment, the relay wetting circuit 100 includes a switching transistor 110 that provides the current at the relay to form the arc, as explained in further detail below.

In operation, the relay 102 may be used in an electrical system for isolation of a voltage from a power source 120 to another electrical component, device or circuit. When the relay 102 is activated or energized, the voltage from the power source 120 may be transferred to the other device as an output at an output terminal 122. However, when the relay 102 is de-activated or de-energized, the power source 120 is not electrically connected to the other device, and no voltage is transferred. In the illustrated embodiment, the power source 120 is connected to the stationary contact 108 of the relay 102 and the output terminal 122 is connected to the movable contact 106 of the relay 102. Thus, when the relay is closed, the power source 120 is connected to the output terminal 122.

When operating the relay 102, a relay power terminal 124 is connected to a first terminal of the relay coil 104 at node A. The relay power terminal 124 energizes the relay coil 104 during operation by supplying a voltage to the first terminal of the relay coil 104. As the voltage is supplied to the relay coil 104, the movable contact 106 is moved from the normally open position to the closed position, and the voltage from the power source 120 is transferred to the output terminal 122. The relay power terminal 124 may be controlled by a control device or control circuit separate from the relay wetting circuit 100. A second terminal of the relay coil 104 is connected to circuit ground via a ground terminal 132 at node B. In the illustrated embodiment, a diode 130, such as a steering or blocking diode, is provided between the relay power terminal 124 and the relay 102. The diode 130 provides reverse battery protection. A capacitor 134 is provided between the ground terminal 132 and the relay power terminal 124. A diode 136, such as a fly-back diode, is provided between the first terminal and the second terminal of the relay coil 104.

A control terminal 140 may be provided in connection with the relay wetting circuit 100. In one embodiment, the control terminal 140 is connected to a base of a control transistor 142 and provides a voltage to the control transistor 142. The operation of the control transistor 142 is thus controlled by the control terminal 140. Optionally, the control transistor 142 may be provided between the power source 120 and the output terminal 122. By controlling the control transistor 142, and thus the supply of power from the power source 120 to the output terminal 122, the control terminal 140 may operate as a safety feature or an additional level of control for safety. In one embodiment, the control transistor 142 represents a Bipolar Junction Transistor (BJT), wherein the emitter of the control transistor 142 is connected to the movable contact 106 of the relay 102 and the collector of the control transistor 142 is connected to the output terminal 122. Alternatively, as illustrated in FIG. 2, the control transistor 142 may represent a three terminal depletion type transistor that is connected between the power source 120 and the output terminal 122. Optionally, a capacitor 144 may be provided between the ground terminal 132 and the control terminal 140. Optionally, a resistor 146 may be provided between the control terminal 140 and the control transistor 142.

The above described components may be used to operate the relay 102 for supplying the voltage from the power source 120 to the output terminal 122. For example, when a voltage is supplied from the relay power terminal 124 to the relay coil 104, the movable contact 106 is moved from the open position to the closed position, wherein the movable contact 106 engages the stationary contact 108. In the closed position, a closed circuit is created, connecting the power source 120 to the output terminal 122. Additionally, the control terminal 140 operates the control transistor 142 to supply the voltage from the power source 120 to the output terminal 122. Once the voltage from the relay power terminal 124 is ceased at the relay coil 104, the movable contact 106 is then moved back to the open position. The electromechanical relay 102 has a drop-out time after the relay coil is de-energized, but before the movable contact 106 is moved to the open position. As such, the movable contact 106 engages the stationary contact 108 for a predetermined amount of time after de-energization of the relay coil 104. The drop-out time may be approximately 10 milliseconds, however, the drop-out time depends upon the particular relay 102. Because the electrical system provided is a dry system, the contacts 106, 108 over time may form a build up of damaging chemicals, such as oxides and hydrocarbons, on the relay contacts 106, 108. The build-up of chemicals may increase the contact resistance which can cause a voltage drop and/or heating of the contacts 106, 108. Additionally, with continued build-up of chemicals, the relay 102 may maintain an open circuit even when the relay 102 is energized and should close. However, and as will be explained below in further detail, the switching transistor 110 loads the relay coil 104 after the relay coil 104 is de-energized to provide an arc between the contacts 106, 108 as the movable contact 106 is moved from the closed position to the open position.

In the illustrated embodiment, the switching transistor 110 is represented by a BJT type transistor having a base, an emitter and a collector. The base is connected to the first terminal of the relay coil 104 at node A. In an exemplary embodiment, a resistor 150 is provided between the base and the first terminal, and a capacitor 152 is provided between the resistor 150 and the ground terminal 132. The emitter of the switching transistor 110 is connected to the movable contact 106 of the relay 102. As such, the emitter is connected to the relay contact that is powered only when the movable contact 106 and the stationary contact 108 engage one another. The collector of the switching transistor 110 is connected to the ground terminal 132 through a load 154. Optionally, the load 154 may be a resistor, an inductor, a capacitor, or the like, and the load 154 may be resistive or inductive. In the illustrated embodiment, the load 154 represents a resistor. In one embodiment, the load 154 is sized to provide a 500 milliamp to 1 amp current through the closed contacts 106, 108 of the relay 102. This current provides the arcing necessary to wet the contacts 106, 108 when the movable contact 106 separates from the stationary contact 108. However, depending on the particular application, a different sized load 154 may be provided to wet the contacts 106, 108. Optionally, the load 154 may be derated since current flow will be limited to the drop-out time of the relay 102.

In an exemplary embodiment, the voltage of the power source 120 is 12VDC, and for the relay wetting circuit 100, the load 154 is 24 Ohms, 1 Watt. Using the formula I=V/R, the contact wetting current is approximately 500 milliamps. Typically, with other wetting circuits, a 6 Watt resistor is used to continuously carry 500 milliamps. With the relay wetting circuit 100, the load 154 is reduced as compared to those other wetting circuits, and the transistor 110 may be sized and may be derated accordingly, thus reducing the cost as compared to those other wetting circuits. Whenever the relay 102 is energized, the base of the switching transistor 110 is pulled to the voltage of the relay power terminal 124, minus the voltage drop due to the diode 130, through the resistor 150. Accordingly, the switching transistor 110 is effectively turned off. Upon de-energization of the relay coil 104 (e.g. voltage from the relay power terminal 124 is removed), the base of the switching transistor 110 senses the voltage drop and turns on or activates the switching transistor 110 thus providing the wetting current to the relay contacts 106, 108. The wetting current generates an arc between the relay contacts 106, 108, to clean the contacts, when the relay contacts 106, 108 separate. The transistor 110 loads the relay coil 104 more quickly than the drop-out time of the relay 102, thus the wetting current is provided at the relay contacts 106, 108 prior to the separation of the contacts 106, 108. The voltage source to the switching transistor 110 is removed when the relay contacts 106, 108 separate, thus current flow through the switching transistor 110 ceases. Optionally, the current flow duration may be dependent on the drop-out time of the relay 102. Optionally, the diode 136 delays the relay drop-out time by providing a path to re-circulate the relay coil current from the second terminal to the first terminal of the relay coil 104. The diode 136 may also prevent transient voltage from inductive kick back of the relay coil 104. Accordingly, the relay wetting circuit 100 provides a wetting current to the relay contacts 106, 108 with the use of the transistor 110.

Figure 3:
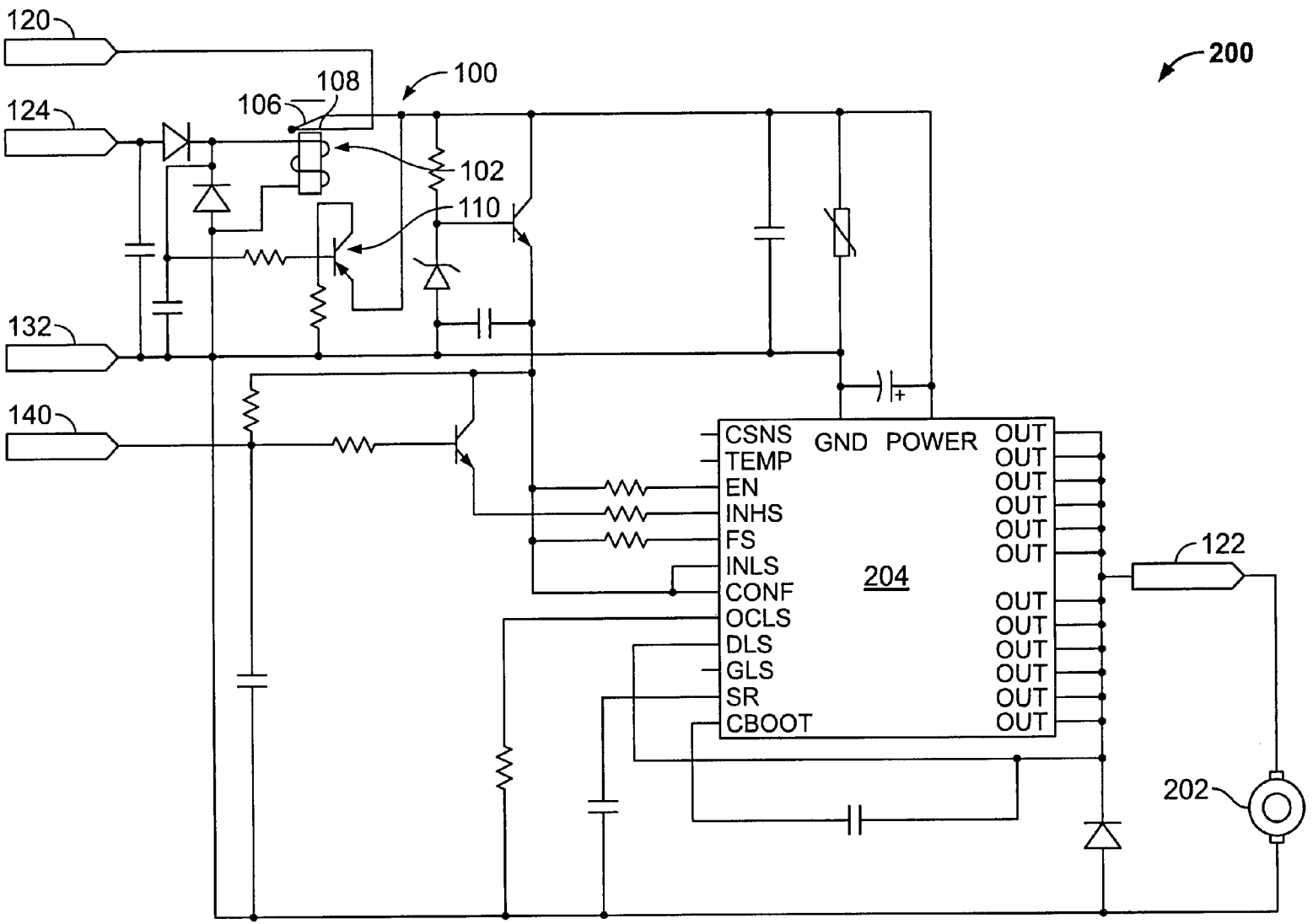
FIG. 3 shows a schematic of an automotive brake circuit that is an exemplary embodiment of a use of the relay of FIG. 1 and the relay wetting circuit of FIG. 2.

FIG. 3 shows a schematic of an automotive brake circuit 200 that is an exemplary embodiment of a use of the relay wetting circuit 100. The relay wetting circuit 100 described with reference to FIG. 2 may be used as a component of the automotive brake circuit 200, and as such, like reference numerals will be used to describe like components. The automotive brake circuit 200 may be used to power a device 202, such as a tail light or an electronic braking mechanism. The device 202 is powered from the power source 120. In one embodiment, the power source is a 12 Volt DC battery.

As described above, the relay 102 is provided for isolation of the power source 120 from the device 202. The relay 102 is energized by the relay power terminal 124. Upon energization, the movable contact 106 is moved from the open position to the closed position, which is illustrated in FIG. 3. When in the closed position, the power source 120 is connected to a controller 204 of the automotive brake circuit 200. The controller 204 sends an output signal to the output terminal 122. When the output signal is received at the output terminal 122, the device 202 is powered. In an exemplary embodiment, the output terminal 122 receives other output signals from the controller 204 and/or other circuitry of the automotive brake circuit 200 before powering the device 202. For example, in the illustrated embodiment, the controller 204 is connected to the control terminal 140, and the controller 204 requires a predetermined input from the control terminal 140 prior to outputting the output signal to the output terminal 122. The controller 204 is also connected to the ground terminal 132.

In operation, when the relay power terminal 124 ceases powering the relay 102, the relay wetting circuit 100 wets the relay contacts 106, 108. As described above in detail, the switching transistor 110 provides a wetting current to the relay contacts 106, 108 such that, when the relay contacts 106, 108 separate, an arc is created between the relay contacts 106, 108 that cleans any chemical build-up formed on the relay contacts 106, 108.

A relay wetting circuit 100 is thus provided that may be arranged and operated in a cost effective and reliable manner. The relay wetting circuit 100 includes a switching transistor 110 that includes a base, an emitter and a collector, wherein the base is connected to the relay coil 104, the emitter is connected to the movable contact 106, and the collector is connected to the ground terminal 132 through the load 154. The relay wetting circuit 100 automatically provides adequate current flow through the relay contacts 106, 108 when the relay 102 is de-energized to generate an arc which burns off any damaging build-up of chemicals. Current flow then stops automatically when the relay contacts 106, 108 are separated. The duration of current flow is dependent on the drop-out time of the relay, and is typically three to ten milliseconds. Additionally, as the wetting current is provided from the switching transistor 110 to the relay coil 104 in a fraction of the drop-out time, the wetting current would be present at the time of separation of the relay contacts 106, 108.

While the invention has been described in terms of various specific embodiments, those skilled in the art will recognize that the invention can be practiced with modification within the spirit and scope of the claims.

What is claimed is:

1. A circuit for wetting relay contacts, the circuit comprising:

a relay having a relay coil, a movable contact and a stationary contact, the movable contact being movable between an open position and a closed position upon energizing of the relay coil, the movable contact engages the stationary contact in the closed position, the movable contact being moved from the closed position to the open position when the relay coil is de-energized;

a transistor connected to the movable contact and a load; and a resistor connected to the transistor and the relay that senses voltage drop at the relay coil and turns on the transistor to load the movable contact after the relay is de-energized to provide an arc between the movable contact and the stationary contact as the movable contact is moved from the closed position to the open position.

2. A circuit in accordance with claim 1, wherein the transistor is activated when the relay coil is de-energized.

3. A circuit in accordance with claim 1, wherein, after the relay coil is de-energized, the relay maintains the movable contact in the closed position for a predetermined drop-out time before the movable contact is moved from the closed position to the open position, the transistor loading the relay coil faster than the predetermined drop-out time.

4. A circuit in accordance with claim 1, wherein the load comprises at least one of a resistor, an inductor and a capacitor.

5. A circuit in accordance with claim 1, wherein the transistor senses a voltage drop at the relay upon de-energization of the relay, and wherein the transistor loads the relay contact after the voltage drop is sensed.

6. A circuit in accordance with claim 1, wherein the transistor provides a wetting current which generates the arc when the movable contact separates from the stationary contact.

7. A circuit in accordance with claim 1, wherein the transistor loads the relay contact with a current between 0.5 Amps and 1.0 Amp.

8. A circuit in accordance with claim 1, wherein the transistor includes a base, an emitter and a collector, the base connected to the relay coil, the emitter connected to the movable contact, and the collector connected to ground through the load.

9. A circuit for wetting relay contacts, the circuit comprising:

a relay having a relay coil, a movable contact and a stationary contact, the relay coil configured to move the movable contact between an open position and a closed position upon energizing and de-energizing of the relay coil; and a transistor connected to the relay, the transistor being positioned between the movable contact and a ground through a load, wherein the load comprises at least one of a resistor, an inductor and a capacitor, and wherein the transistor loads the relay contact after the relay coil is de-energized to provide an arc between the movable contact and the stationary contact as the movable contact is moved from the closed position to the open position.

10. A circuit in accordance with claim 9, wherein the transistor includes a base, an emitter and a collector, the base connected to the relay coil, the emitter connected to the movable contact, and the collector connected to ground through the load.

11. A circuit in accordance with claim 9, wherein the transistor is activated when the relay coil is de-energized.

12. A circuit in accordance with claim 9, wherein, after the relay coil is de-energized, the relay maintains the movable contact in the closed position for a predetermined drop-out time before the movable contact is moved from the closed position to the open position, the transistor loading the relay contact faster than the predetermined drop-out time.

13. A circuit in accordance with claim 9, wherein the transistor provides a wetting current which generates the arc when the movable contact separates from the stationary contact.

14. A circuit in accordance with claim 9, wherein the transistor loads the relay contact with a current between 0.5 Amps and 1.0 Amp.

15. A circuit in accordance with claim 9, further comprising a resistor between a base of the transistor and the relay.

16. A circuit in accordance with claim 9, wherein the transistor senses a voltage drop at the relay upon de-energization of the relay, and wherein the transistor loads the relay contact after the voltage drop is sensed.

17. A method of wetting relay contacts comprising;

providing an electromechanical relay having a coil, a movable contact and a stationary contact;

energizing the coil to move the movable contact to a closed position in contact with the stationary contact;

de-energizing the coil to allow the movable contact to move to an open position; and maintaining a load on at least one of the movable contact and the stationary contact after the relay is de-energized using a wetting circuit having a transistor by sensing a voltage drop at the coil and providing a current path from the transistor to the relay when the voltage drop is sensed.

18. A method in accordance with claim 17, further comprising:

connecting a base of the transistor to a coil of the relay through a first resistor;

connecting an emitter of the transistor to the movable contact of the relay; and connecting a collector of the transistor through a load to a ground terminal.

* * * * *